US007686468B2

(12) United States Patent
Leanza

(10) Patent No.: US 7,686,468 B2
(45) Date of Patent: Mar. 30, 2010

(54) ILLUMINATED CLIPBOARD WITH LCD DISPLAY AND RECORDER AND METHOD OF USE

(76) Inventor: Anthony S. Leanza, 27396 Sprague Rd., Olmsted Township, OH (US) 44138

( * ) Notice: Subject to any disclaimer, the term of this patent is extended or adjusted under 35 U.S.C. 154(b) by 152 days.

(21) Appl. No.: 11/904,020

(22) Filed: Sep. 25, 2007

(65) Prior Publication Data

US 2008/0239703 A1 Oct. 2, 2008

Related U.S. Application Data

(60) Provisional application No. 60/847,608, filed on Sep. 27, 2006.

(51) Int. Cl.
*F21V 33/00* (2006.01)

(52) U.S. Cl. ..... 362/99; 362/234; 235/487

(58) Field of Classification Search ..... 362/98–99, 362/253; 235/487
See application file for complete search history.

(56) References Cited

U.S. PATENT DOCUMENTS

| | | | | |
|---|---|---|---|---|
| 6,262,764 | B1 * | 7/2001 | Perterson | 348/148 |
| 7,277,241 | B1 * | 10/2007 | Fulton | 359/805 |
| 7,295,922 | B2 * | 11/2007 | Simon et al. | 701/208 |
| 2006/0002107 | A1 * | 1/2006 | Jeong | 362/225 |
| 2007/0253187 | A1 * | 11/2007 | Cohan et al. | 362/98 |

* cited by examiner

*Primary Examiner*—Ali Alavi
(74) *Attorney, Agent, or Firm*—Tarolli, Sundheim, Covell & Tummino LLP

(57) ABSTRACT

An illuminated clipboard, including a clipboard base, a license receiving area located on the clipboard base, and a license camera having a display for selectively displaying to a clipboard user an operator license that may be present at the license receiving area and an actuatable recording device for, when actuated, recording information present on the license present at the license receiving area.

8 Claims, 4 Drawing Sheets

ILLUMINATED CLIPBOARD WITH LCD DISPLAY AND RECORDER AND METHOD OF USE

RELATED APPLICATION

This application claims priority to U.S. Provisional Patent Application No. 60/847,608, filed Sep. 27, 2006.

TECHNICAL FIELD

The present invention relates to a clipboard and more particularly, to an illuminated clipboard that assists a police officer in writing a traffic ticket, recording license information, and a method for using same.

BACKGROUND OF THE INVENTION

Clipboards are used for many different applications such as securely holding papers and providing a user with a portable and convenient writing surface. Because of their portability, clipboards are often used in an environment that is not otherwise conducive to writing of information on paper. For instance, police officers normally use a clipboard as an aid to issue traffic tickets at the site of a traffic stop. Furthermore, traffic tickets may be issued at night when it is difficult for the issuing officer to efficiently fill out the ticket form using a traditional clipboard. At night, it is particularly difficult for a police officer to view a driver's license and copy driver's information from the driver's license to the ticket form without returning to police vehicle. Though officers normally carry a flashlight, it is awkward for the officer to hold the flashlight while simultaneously holding the clipboard, writing, and reading small print on the driver's license. All information about a person being stopped for a traffic offence is recorded by the officer reading the information from the offender's driver's license and writing the information onto a ticket.

U.S. patent application Ser. No. 11/300,815 to Leanza entitled ILLUMINATED CLIPBOARD AND METHOD OF USING SAME, which is hereby fully incorporated herein by reference, discloses an illuminated clipboard and method of use to aid police officers issue traffic tickets at night.

SUMMARY OF THE INVENTION

In an example of an embodiment of the present invention, a clipboard includes a clipboard base, a license receiving area located on the clipboard base, and a license camera having a display for selectively displaying to a clipboard user an operator license that may be present at the license receiving area and an actuatable recording device for, when actuated, recording information present on the operator license present at the license receiving area.

In yet another example of an embodiment of the present invention, a method is provided for issuing a ticket including the steps of obtaining an operator license from a driver to be ticketed, placing the operator license at a license receiving area associated with a clipboard base, selectively displaying information present on the operator license to a clipboard user, and activating a recorder for electronically recording information present on the operator license at the license receiving area.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF PREFERRED EMBODIMENT

Figure 1:
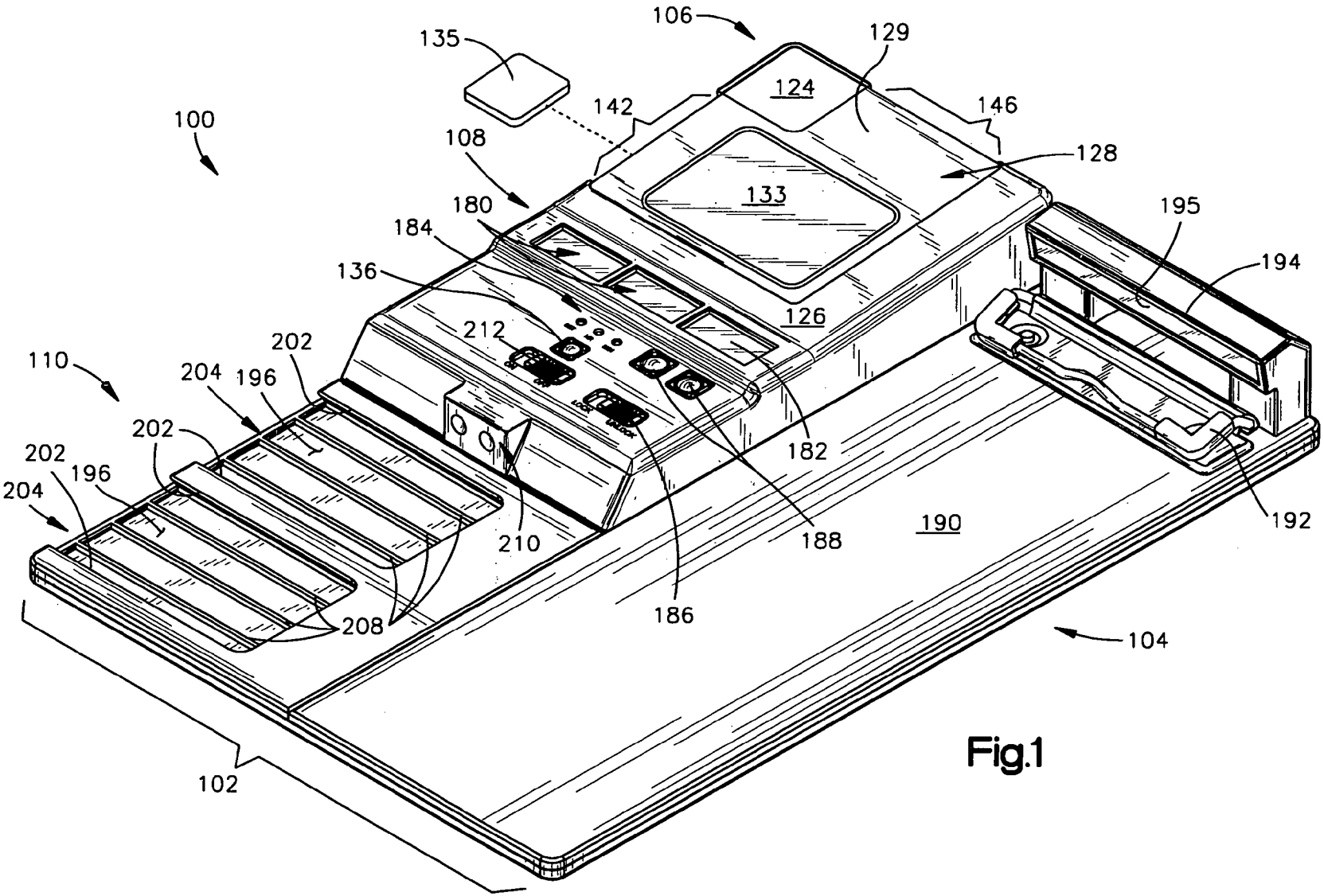
FIG. 1 is a perspective view of an example embodiment of the present invention.

Referring to FIGS. 1-5, one example embodiment of the present invention is shown. Other embodiments of the present invention are possible, the example embodiment shown for explanation purposes. An illuminated clipboard 100, in accordance with this one example embodiment, includes a clipboard base 102 having an illuminated ticket-writing area 104, a license receiving/viewing/recording device 106, a date, clock, and court date information area 108, and an illuminated supplemental license receiving/holding area 110. The clipboard 100 may be made in dimensions other than that specifically shown and described depending on the particular desired use of the clipboard 100. For the purposes of explanation, the clipboard 100 is described to aid police officers in issuing traffic tickets. Other purposes of the clipboard 100 are possible. In that regard, the position and orientation of elements 104, 106, 108, and 110 of the clipboard 100 described herein may be other than that specifically shown, again, depending on the particular desired use of the clipboard. The clipboard 100 may be made from any suitable material, including, but not limited to plastic, wood, chipboard, cardboard, metal, and the like or any combination of materials. For the purpose of explanation, the example embodiment of the clipboard 100 shown and described is made substantially of plastic with some metal parts.

The license receiving/viewing/recording device 106 of the clipboard 100 is located at one corner area, e.g., upper left corner area of the clipboard base 102, as viewed in FIG. 1. The license receiving/viewing/recording device 106 may be integrally formed as part of the clipboard base 102 or may be a separate part secured to the base 102 via screws (not shown) through the clipboard base 102.

The license receiving/viewing/recording device 106 has a recess portion 122 (see FIG. 3) with a bottom wall 120 and bordered between sides portions 124 and 126. The receiving/viewing/recording device 106 further includes a camera assembly 128 received in the recess 122 so as to extend over and cover bottom wall 120. In accordance with one example embodiment, camera assembly 128 includes a housing 129 having a bottom wall 130 and an upper wall 131. The housing 129 of the camera assembly 128 can be mounted and secured into the recess portion 122 by various means including snap fitting using associated tabs (not shown) received into associated apertures (not shown) in side walls 152, 154 rising up from the bottom wall 120 of the recess 122. The camera assembly 128 makes electrical connection with the remainder of the license receiving/viewing/recording device 106 via an electrical connector 155 and its associated electrical connector on the camera assembly 128 (not shown). All communication signals, control signals, and electrical power connections needed for the camera assembly 128 are made through the connector 155. Of course, those skill in the art will appreciate that that camera assembly 128 could be self contained with power and a control switch as part on the assembly 128 itself.

The bottom wall 130 of the camera assembly 128 and the bottom wall 120 (FIG. 4) of recess portion 122 are spaced apart and form a rectangular narrow slit opening 142 (FIG. 4) on the left side (as viewed from FIGS. 1 and 2) of the clipboard 100 and a rectangular narrow slit opening 146 (FIG. 5) on the top side (as viewed from FIGS. 1 and 2) of the clipboard 100. The first opening 142 on the left side of the clipboard 100 is a rectangular narrow slit dimensioned commensurate with that of known driver's licenses having information arranged across the wider dimension of the license such as license 144 shown in FIG. 2. The second opening 146 at the top of the clipboard 100 formed by the camera assembly 128 and the bottom wall 120 is a rectangular narrow slit dimensioned commensurate with that of known driver's licenses having information arranged across the narrower dimension of the license such as the license 148 shown in FIG. 2. When a license 144 or 148 is slid into the associated slit of the license receiving/viewing/recording device 106, the information on the license can be viewed and recorded using the camera assembly 128.

The camera assembly 128 further includes a camera lens 132 and a display 133 such as a liquid crystal display ("LCD") 133. When the camera 128 is activated, a driver's license (also referred to as an operator's license) placed in the viewing slots 142, or 146, can be viewed by the clipboard operator through the LCD display 133 which is automatically actuated to an ON condition. The camera assembly 128 further includes a memory card slot 134 in which a digital memory card 135 can be mounted for the recording of information on a driver's license placed in a viewing slot 142, 146. The camera assembly 128, in effect, takes a digital picture of the driver's license and places the information contained thereon in memory (in a digital format) on the memory card 135 via activation of a camera actuation button 136. The activation button 136 can be on the receiving/viewing/recording device 106 or can be directly on the camera assembly 128.

An illumination source 156 is provided to illuminate the license receiving/viewing/recording device 106 of the clipboard 100 so as to aid in reading information on a driver's license 144 or 148 positioned by a clipboard user into one of the slots 142, 146 of the license receiving/viewing/recording device 106 and to aid in viewing/recording by the camera assembly 128. The license illumination source 156 may include, in accordance with one example embodiment, four incandescent light bulbs, e.g., white light sources, or light emitting diodes ("LEDs"), located in side walls 152, 154 and positioned to direct visible light toward the recess 122 so as to illuminate a driver's license 144 or 148 in the receiving/viewing/recording device 106 to aid in viewing written information on the driver's license and the recording of the information by the camera assembly 128 when actuated to digitally record the information.

The words "license" and "card" are used herein to reference any sort of operator's license, ID card, credit or debit card, proof of insurance card, vehicle registration card, permit, order form, or other document which contains some sort of written or graphical information and is sized to be received in the receiving/viewing/recording device 106 of the illuminated clipboard 100.

The license information is reviewable by a clipboard user who optionally copies information from the license 144 or 148 onto another document or form such as a traffic ticket or accident report held in the ticket-writing portion of the clipboard 104. The terms "form," "ticket," "ticket blank," "ticket form," and "report" are used herein to indicate any document or form, other than the viewed license 144 or 148, that is reviewed, referenced, or filled out by the party using the clipboard 100.

The camera assembly 128 is, in accordance with one example embodiment, controlled to magnify the license information to facilitate reading of printed information on the license 144 or 148 for the clipboard operator. The amount of the magnification can either be preset or can be controlled via appropriate supplied control switch (not shown) on the clipboard. The plurality of visible light sources 156, when turned ON, illuminate the recess area 122 from a transverse direction.

In accordance with one example embodiment, the license receiving/viewing/recording device 106 further includes finger openings 160, 162 to facilitate easy and complete insertion and removal of the licenses 148, 144, respectively, by a user. The user may insert a finger into the appropriate finger openings to urge the license 144 or 148 into or out of the license receiving/viewing/recording device 106.

In accordance with one example embodiment, the license receiving/viewing/recording device 106 includes pressure actuated momentary switches 170, 178 that extend up above the bottom wall 120 and are engaged by a leading edge of the license 148, 144, respectively, when inserted into the license receiving/viewing/recording device 106. The license 148 or 144, upon being inserted, depresses the associated momentary switch downward, aided by force from the bottom wall 130 of the camera assembly 128, in a pinching or compression action. The momentary switches 170, 178 are logically OR'ed so as to control the illumination source 156 via circuitry, not shown, when either switch is depressed. The inserted license 148 or 144 holds its associated switch 170, 178 down until the license is removed. In accordance with one example embodiment, when one of the licenses 148 or 144 is inserted and holds its associated switch 170, 178 down or activated (i.e., pressed down), the visible light sources 156 are turned ON and remain ON until the license 148 or 144 is removed. When the light sources 156 are ON, the LCD display 133 of the camera assembly 128 is activated ON so that the license can be viewed through the LCD screen. This gives the clipboard operator time to view any information on the driver's license 144 or 148 through the LCD screen 133, record the information on a ticket held in the ticket area 104, and to take a picture of the license, i.e., made a digital record of the license, by activating the camera switch 136. The digital information stored on the card 135 can be later downloaded into a permanent memory at the police station.

In accordance with another embodiment of the invention, the illuminated clipboard 100 also includes a date, time, and court date information area 108. The information area 108 includes at least one of a first date/time display 180 and a second court date display 182. Often, a traffic ticket form provides space for an issuance date and time to be recorded on the ticket, requiring that the issuing officer consult a clock or calendar during issuance of the ticket. The first date/time display 180 is adapted to display at least one of a current date and time so that the issuing officer may quickly ascertain correct issuance information. Similarly, the ticket form often requires that the issuing officer assign a court appointment upon issuance of the ticket, so that the ticketed driver may appear in court personally to defend against the ticket. The assigned court appointment generally is automatically and arbitrarily chosen to be a business day in the future, e.g., a particular jurisdiction might always assign the first Monday at least two weeks after the issuance date. However, an officer issuing a ticket may have difficulty quickly calculating this sort of arbitrary time-based court appointment mentally, particularly if the officer is working near the (midnight) date change on an overnight shift or if the assigned court appointment based on such a set delay period would fall on a weekend, holiday, or otherwise outside business hours for the court. Thus, the illuminated clipboard 100 optionally includes a second court date display 182 adapted to display at least one of a future time and a future date, referred to herein as the court date. When provided, the future date and future time optionally indicate an appointed court date. Dates can automatically be superimposed onto the photos taken by the camera if desired.

Optionally, the illuminated clipboard 100 includes a setting device 184 adapted to allow the clipboard user setting of the date/time display 180. Larger buttons 188 and a setting enable switch 186 are used to set the court date display. The setting enable switch 186 enables and disables the larger buttons 188 so that the court date is not accidentally changed if the larger buttons 188 are bumped, while still preserving the ease of use of the larger buttons in changing the court date as needed since the court date is changed on a frequent basis.

In accordance with one example embodiment, the displays 180, 182 are backlit displays that are backlit when a master power switch 220 of the clipboard 100 is activated ON. Otherwise, the information on displays 180, 182 can be viewed with reflective light.

The clipboard base 102 optionally further includes a ticket-writing area 104 having a ticket-holding area 190, which includes a ticket-clip 192 for removably holding a ticket form, or a book of ticket forms, to the clipboard base 102. The ticket-holding area 190 provides support for the ticket while the officer is copying information from the license onto the ticket. The ticket-clip 192 may be of any suitable type to hold the ticket to the clipboard base 102, including but not limited to a spring-loaded clip, a friction clip, an adhesive patch, a transparent cover, a set of posts adapted to mate with holes in the ticket, or the like. The precise nature of the ticket-clip 192 is not essential to the present invention and may be readily determined for a particular application by one of ordinary skill in the art. Optionally, a ticket-area illumination source 194 is adapted to selectively illuminate the ticket-holding area 190. The illumination source 194 includes a plurality of LED's oriented behind a glass or clear plastic cover 195 and oriented to direct visible light onto the ticket-writing area 190. The LED's of the illumination source 194 are turned ON and OFF via control of a master power switch 220.

Optionally, the illuminated clipboard 102 also includes at least one auxiliary license holding area 110 including at least one auxiliary license holding slot 196 adapted to removably hold an auxiliary license 200 to the clipboard base 102. In accordance with one exemplary embodiment, the auxiliary license 200 is held to the clipboard base 102 via channels 202 formed in a recess 204 dimensioned commensurate with a license. The bracket members 202 optionally are right-angle brackets 202 that form receiving channels 206 to receive and hold the edges of each auxiliary license 200. Each auxiliary license slot 196 may also include at least one spacing rib 208 which spaces or separates the auxiliary license 200 apart from the clipboard base 102 within the auxiliary license slot 196. The spacing ribs 208 facilitate sliding of the auxiliary license 200 into and out of the auxiliary license slot 196.

Optionally, an auxiliary license illumination source 210 is associated with the auxiliary license slot 196 and is adapted to selectively illuminate the auxiliary license 200 or other information card placed into the auxiliary slots 196. For example, a pressure switch much like the pressure switches 170, 178 could be used to automatically actuate the illumination source 210 when an auxiliary license 200 is inserted. Optionally, an illumination source switch 212, which may be a slide switch, is used to selectively control the illumination source 210.

Optionally, a master switch 220 simultaneously turns ON and OFF the illumination sources 194 and 210 and the backlit function of displays 180, 182. When the master switch 220 is ON, the illuminating source 210 can be controlled by switch 212. The clipboard 100, in one example embodiment, includes rechargeable internal batteries that can be recharged by connection to a vehicle via a plug-in adapter or a wall plug charger arrangement (not shown).

Optionally, a pen/pencil clip 230 is provided on the clipboard base 102 to facilitate attachment of a writing instrument to the illuminated clipboard 100 for the user's convenience.

Figure 6:
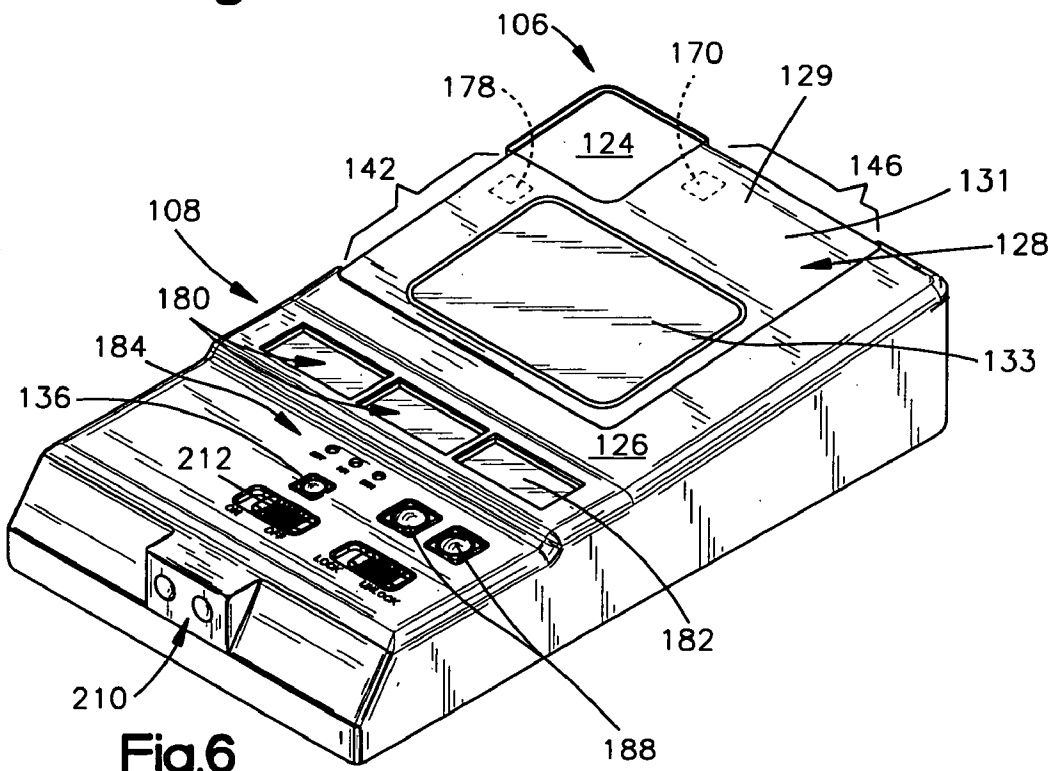
FIG. 6 is a perspective view of another example embodiment of the present invention.
Figure 5:
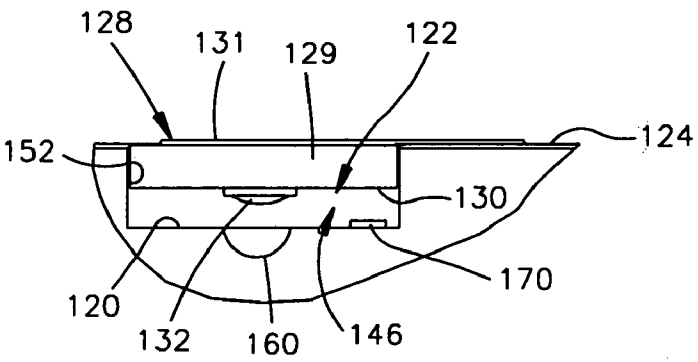
FIG. 5 is a partial side elevational view of a portion of the example embodiment of the present invention shown in FIG. 1.

FIG. 6 depicts another example embodiment of the present invention in which the receiving/viewing/recording portion 106 is a stand-alone unit. All other functions described with regard to this unit are the same as described above absent the attachment to the clipboard 102. The receiving/viewing/recording portion 106 is used to view and record driver's license, operator's license, or identification information using the camera assembly 128 in a similar manner as described above. Like numbers refer to like parts having the same function as described above.

Figure 2:
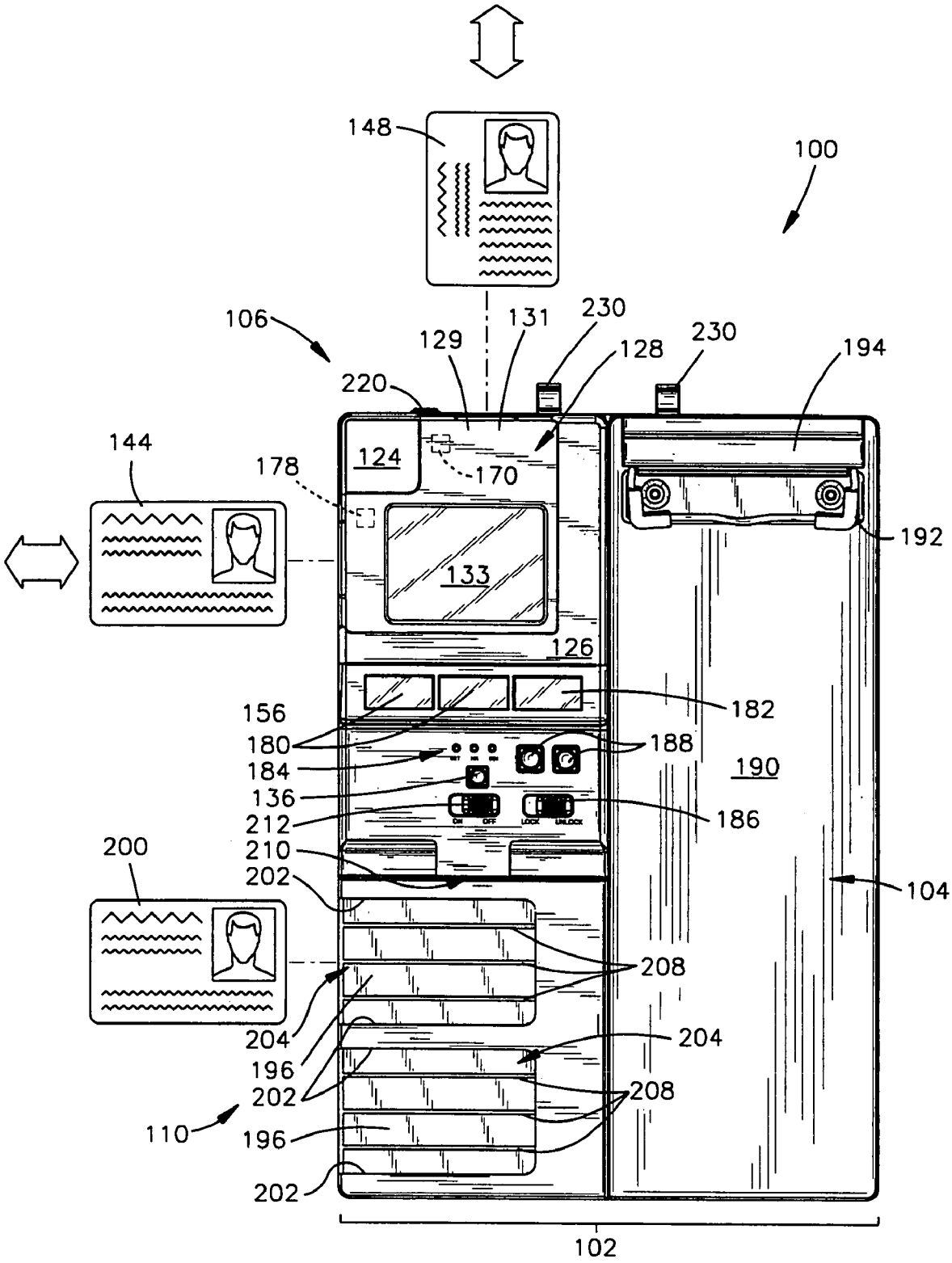
FIG. 2 is a top plan view of the example embodiment of the present invention shown in FIG. 1 showing how an operator's or drivers' licenses could be slid into a receiving/viewing/recording device or area of the present invention.
Figure 3:
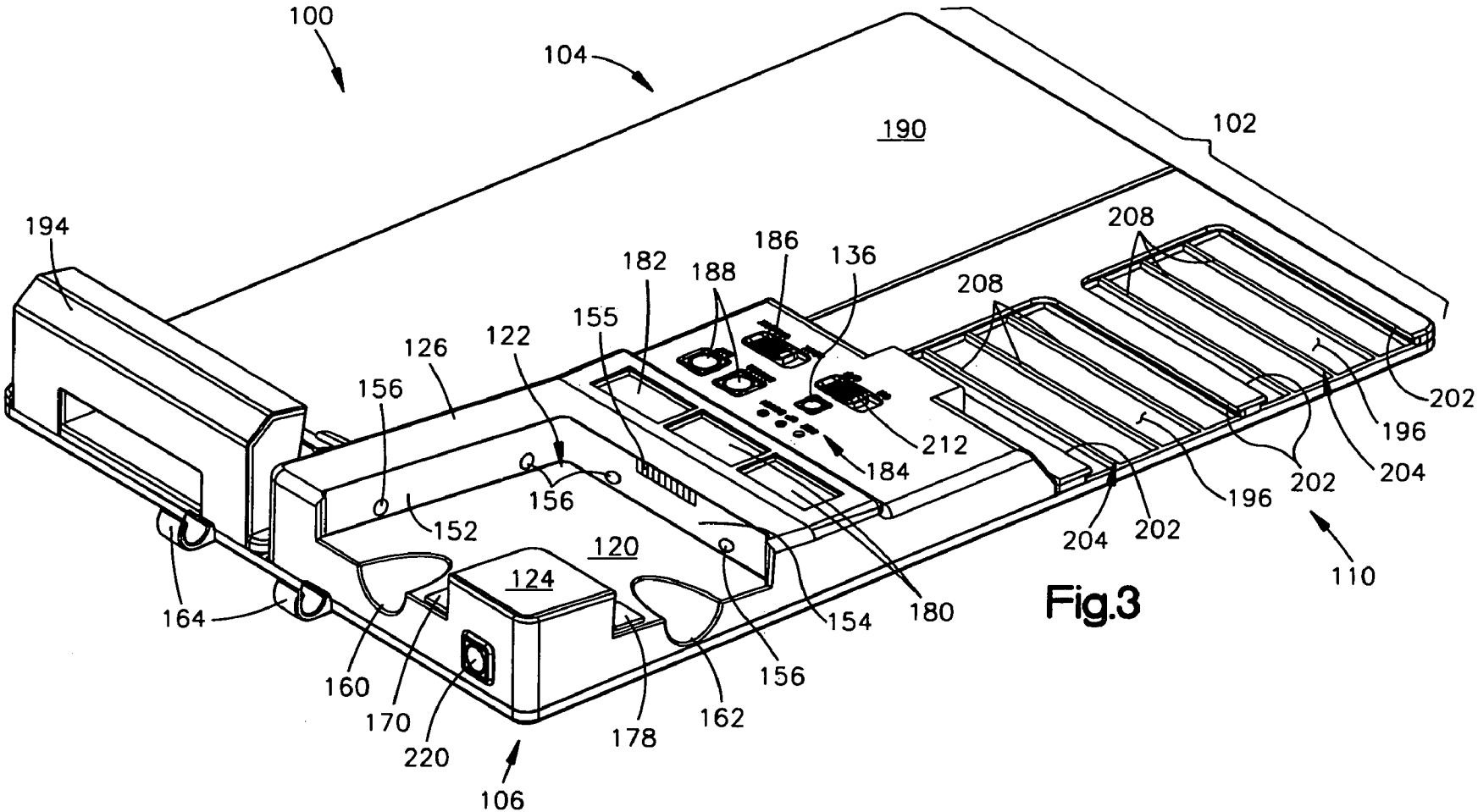
FIG. 3 is another perspective view of the example embodiment of the present invention shown in FIG. 1 with certain parts removed for clarity.
Figure 4:
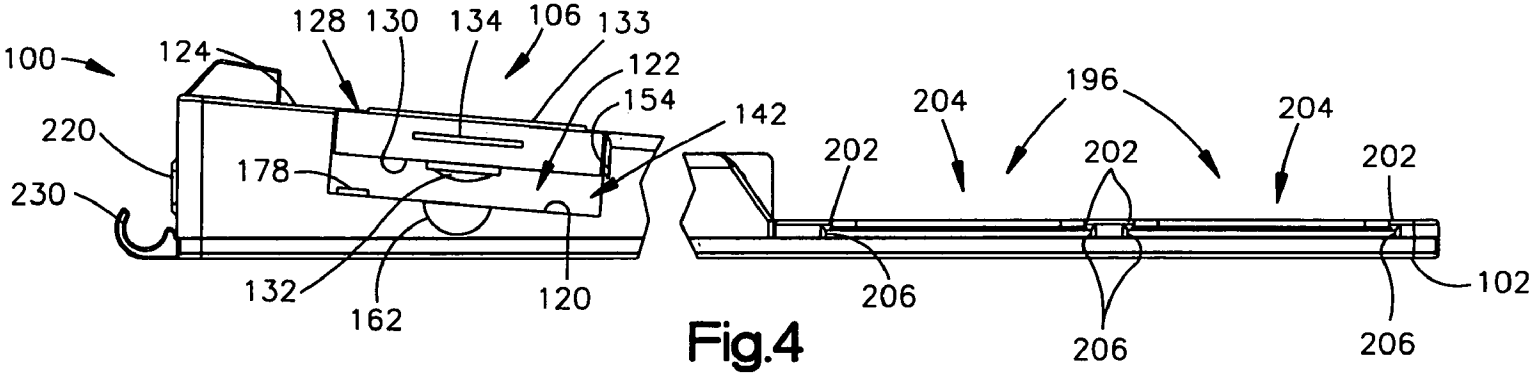
FIG. 4 is a partial side elevational view of the example embodiment of the present invention shown in FIG. 1.

A police officer may issue a traffic ticket at night using the example embodiment of the invention shown in FIGS. 1-5. Assume an officer pulls over the violating car and the officer is equipped with a clipboard in accordance with this example embodiment of the present invention. He obtains a license from the driver to be ticketed. Optionally, the officer also obtains at least one other document, e.g., proof of insurance from the driver or a license of a passenger in the car. The officer activates the master switch 220 that illuminates the ticket-holding area 190 with the illumination source 194. He places the license 144 or 148 into the license receiving/viewing/recording device 106 and places the proof of insurance card in one of the auxiliary slots 196 and activates the light source 210. Sliding the license into the license receiving/viewing/recording device 106, as shown in FIG. 2, depresses an associated one of the pressure switches 170, 178 to illuminate the license receiving/viewing/recording device 106 with the visible light sources 156. The LCD 133 portion of the camera assembly 128 is automatically activated ON so that the license present in the receiving/viewing/recording device 106 is easily readable by the police officer through LCD screen 133. The officer may choice to make a permanent record of the license by activating the switch 136 which digitally records or takes a picture of the license and stores the picture in digital format on the digital storage card 135. The digital storage card can be removed from the camera assembly 128 at the police station and data downloaded into a police storage server for permanent storage of the information or the information printed out.

The officer places a traffic ticket blank to the ticket-holding area 190 and secures it there using the metal clip 192. The illumination source 194 illuminates the ticket-holding area 190 when the master switch 220 is activated. The illumination source 194 allows the officer to clearly see to write the driver information seen through the LCD display 133 onto the traffic ticket blank.

The officer obtains information from the license 144 or 148 via the LCD display 133, at least one of current date and current time information from the LCD display 180, and at least one of future date and future time information from the display 182. When all of the desired information has been obtained, a completed traffic ticket is created by the officer's writing at least one of the driver information, current date and current time information, and future date and future time information on the traffic ticket blank.

If the officer has collected at least one auxiliary license 200, such auxiliary license 200 or proof of insurance card may be held to the clipboard base 102 in the auxiliary license slot 196, when provided. In such case, the illumination source 210 may be used to selectively illuminate the auxiliary license 200 or proof of insurance card, through use of the illumination source switch 212 once the master switch 220 has enabled the illumination source 210. The officer can then readily collect any desired information from the auxiliary license 200 or proof of insurance card, simultaneously or in series with collecting driver information using the license receiving/viewing/recording device 106. That card could then be placed into the license receiving/viewing/recording device 106 and a picture of that card taken for recording purposes for later download.

From the above description of the invention, those skilled in the art will perceive improvements, changes and modifications in the invention. Such improvements, changes and modifications within the skill of the art are intended to be covered by the appended claims.

Having described the invention, the following is claimed:

1. An illuminated clipboard, comprising:

a clipboard base;

a license receiving area located on the clipboard base; and a license camera having a display for selectively displaying to a clipboard user an operator license that may be present at the license receiving area and an actuatable recording device for, when actuated, recording information present on the license present at the license receiving area.

2. The illuminated clipboard of claim 1, wherein a portion of the clipboard base further includes a ticket-holding area, the ticket-holding area including a ticket-clip for removably holding a ticket to the clipboard base in the ticket-holding area.

3. The illuminated clipboard of claim 2, including a ticket illumination source adapted to selectively illuminate the ticket-holding area.

4. The illuminated clipboard of claim 1, wherein the license camera includes a removable memory card for storing said record information in digital format.

5. The illuminated clipboard of claim 1, wherein the license camera includes a LCD display and means for controlling display magnification.

6. A method for issuing a ticket including the steps of:

obtaining an operator license from a driver to be ticketed;

placing the operator license at a license receiving area associated with a clipboard base;

selectively displaying a digital picture of information present on the operator license to a clipboard user; and activating a recorder for electronically recording information present on the operator license at the license receiving area.

7. The illuminated clipboard of claim 1, wherein the display selectively displays a digital picture of the operator license to the clipboard user.

8. The illuminated clipboard of claim 1, wherein the clipboard base includes a recessed portion for receiving the license camera, the recessed portion having a bottom wall and the license receiving area being located between the bottom wall and the license camera.

* * * * *